US008739674B1

(12) United States Patent
Huber et al.

(10) Patent No.: US 8,739,674 B1
(45) Date of Patent: Jun. 3, 2014

(54) MUZZLE BRAKE COVER WITH BLAST DIVERTER

(71) Applicants: David C. Huber, Victoria, TX (US); Christopher P. Lucci, Rockport, TX (US)

(72) Inventors: David C. Huber, Victoria, TX (US); Christopher P. Lucci, Rockport, TX (US)

( * ) Notice: Subject to any disclaimer, the term of this patent is extended or adjusted under 35 U.S.C. 154(b) by 0 days.

(21) Appl. No.: 13/680,577

(22) Filed: Nov. 19, 2012

Related U.S. Application Data

(60) Provisional application No. 61/563,421, filed on Nov. 23, 2011.

(51) Int. Cl.
*F41A 21/32* (2006.01)

(52) U.S. Cl.
USPC ..... 89/14.2

(58) Field of Classification Search
USPC ..... 89/14.2, 14.4, 14.05, 14.3, 14.5, 198; 42/1.06, 75.02, 79
See application file for complete search history.

(56) References Cited

U.S. PATENT DOCUMENTS

| | | | | | |
|---|---|---|---|---|---|
| 1,342,978 | A * | 6/1920 | Young | 89/14.3 |
| 3,483,794 | A * | 12/1969 | Packard | 89/14.2 |
| 4,024,791 | A | 5/1977 | Stratman | |
| 4,176,487 | A * | 12/1979 | Manis | 42/76.01 |
| 5,092,223 | A | 3/1992 | Hudson | |
| 6,837,139 | B2 * | 1/2005 | Meyers | 89/14.2 |
| 6,899,008 | B2 * | 5/2005 | Breuer | 89/14.3 |
| 7,302,774 | B2 * | 12/2007 | Meyers | 42/77 |
| 7,594,464 | B2 * | 9/2009 | Dueck | 89/14.4 |
| 8,104,394 | B2 * | 1/2012 | Meyers | 89/14.2 |
| 2004/0123729 | A1 * | 7/2004 | Meyers | 89/14.2 |
| 2004/0244571 | A1 * | 12/2004 | Bender | 89/14.3 |
| 2005/0066802 | A1 * | 3/2005 | Meyers | 89/14.2 |
| 2007/0266844 | A1 * | 11/2007 | Dueck | 89/14.4 |
| 2009/0178549 | A1 * | 7/2009 | Meyers | 89/14.2 |
| 2012/0125184 | A1 * | 5/2012 | Meyers | 89/14.2 |

* cited by examiner

*Primary Examiner* — Jonathan C Weber

(74) *Attorney, Agent, or Firm* — Buskop Law Group, PC; Wendy Buskop

(57) ABSTRACT

A muzzle brake cover for providing blast diversion for firearms which include an extension for attachment on an end of a muzzle brake or flash suppressor. The extension can have a cylindrical inner surface of an inner diameter larger than that of the extension outer diameter of the muzzle brake or flash suppressor, concentric rings extending around the cylindrical inner surface, a threaded portion, a smooth portion disposed between the concentric rings and the threaded portion for fitting over portions of the muzzle brake, and a collar comprising a plurality of tightening surfaces for allowing quick tightening of the muzzle brake cover.

8 Claims, 2 Drawing Sheets

MUZZLE BRAKE COVER WITH BLAST DIVERTER

CROSS REFERENCE TO RELATED APPLICATION

The current application claims priority to and the benefit of U.S. Provisional Patent Application Ser. No. 61/563,421 filed on Nov. 23, 2011, entitled "MUZZLE BRAKE COVER WITH BLAST DIVERTER". This reference is hereby incorporated in its entirety.

FIELD

The present embodiments generally relate to a muzzle brake cover providing blast diversion for firearms.

BACKGROUND

Muzzle brakes are designed to reduce the recoil that occurs when a rifle is fired. The recoil of a rifle occurs because of at least two forces that are related to the firing of the projectile.

The first force is the force that the explosive powder expends on both the projectile and the rifle, which is applied in all directions equally and propels the projectile.

The second force comes from the burst of combustion gases that follow the departure of the projectile from the chamber of the rifle.

Muzzle brakes work by diverting the expanding gases at an angle, which prevents the force from being translated toward the person firing the weapon.

However, the reduction in recoil achieved by a muzzle brake has the cost of increasing the sound perceived by the user as well as increased lead exposure for the user and nearby bystanders.

A need exists for a muzzle brake cover which can divert the sounds produced by the muzzle brake.

A further need exists for a muzzle brake cover that can reduce or prevent the flow of toxic particles from the barrel of the rifle, through the muzzle brake, to the user.

The present embodiments meet these needs.

BRIEF DESCRIPTION OF THE DRAWINGS

The detailed description will be better understood in conjunction with the accompanying drawings as follows.

Figure 1:
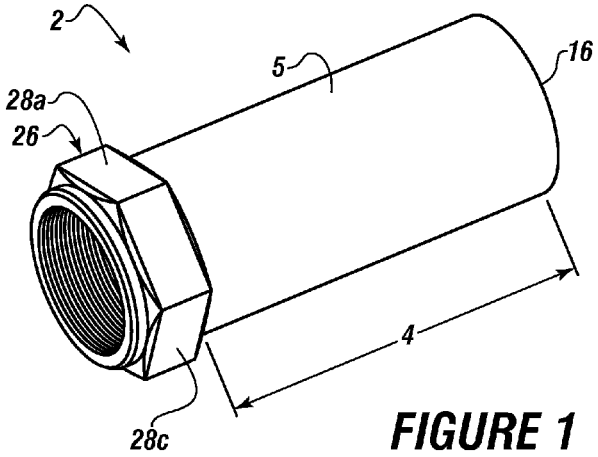
FIG. 1 depicts a side view of a muzzle brake cover according to one or more embodiments.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments generally relate to a muzzle brake cover providing blast diversion for firearms.

The muzzle brake cover can provide benefits of both having a silencer or using only a muzzle brake, by interchanging the silencer and the muzzle brake cover in the field.

The muzzle brake cover can divert blast and damaging sound away from the shooter, which can protect the shooter and nearby individuals from loss of hearing.

The muzzle brake cover can protect the muzzle brake from external damage, such as damage to the threads or attachment surfaces for suppressors.

The muzzle brake cover can provide blast diversion by extending beyond the muzzle brake.

The muzzle brake cover can increase the marketability of currently existing muzzle brakes, which can stimulate economic growth in the firearms sector.

The muzzle brake cover can have an extension adapted for attachment on an end of a muzzle brake or flash suppressor of a gun.

The extension can have a cylindrical inner surface with a diameter larger than that of the outer diameter of the muzzle brake or flash suppressor. For example, a muzzle brake cover with an extension that has a diameter of 23 millimeters designed to fit over a 19 millimeters outer diameter muzzle brake.

The extension can have concentric rings. The concentric rings can extend around the inner walls of the extension. The concentric rings can assist in flash suppression or blast diversion, such as concentric rings with internal cuts are designed to offer resistance to expanding gas movement and reducing lateral or rearward noise away from the user.

The muzzle brake cover can have a threaded portion which can extend around the inner walls of the extension. The threaded portion can engage a muzzle brake, such as one or more threads designed to connect with the outer surface of the muzzle brake.

The muzzle brake cover can have a smooth portion disposed between the concentric rings and the threaded portion, such as a smooth portion making up about 5 millimeters of the inner surface of a muzzle brake cover between the concentric rings and the connecting means.

The extension can have the threaded portion for fitting over portions of the muzzle brake, such as threads or an external clamping mechanism which allow the muzzle brake cover to be affixed to either the barrel of the rifle or to the muzzle brake itself.

The muzzle brake cover can have a collar comprising a plurality of tightening surfaces. The tightening surfaces can allow quick tightening of the muzzle brake cover over a muzzle brake or flash suppressor of a firearm, such as a hand-tightenable threading with a grippable surface to allow quick connection to the muzzle brake.

The muzzle brake cover can have a threaded portion which can have a connecting means for engaging a muzzle brake or a flash suppressor, such as threads, a clamp, a hex head, or an external clamping mechanism.

The muzzle brake cover can have a muzzle brake, which is a device that has a bore through which a projectile and propelling gas pass in exiting the muzzle of a firearm.

An embodiment of the muzzle brake cover can connect with a muzzle brake which has a bore with at least one opening for venting a portion of the propelling gases which can create a directional reaction force for offsetting a recoil or other motion of the muzzle when the firearm is fired, such as a muzzle brake designed to vent expanding gases laterally to dissipate the force of ejecting the projectile.

The muzzle brake cover can have a flash suppressor which has a chamber which can include a slot, a groove, a baffle, or combinations thereof. The flash suppressor can have a bore in line with the path of the projectile and can have a gas exit channel or slot for exhausting or diverting a portion of the propellant gases with the respect to the path of the projectile, which can reduce a flash signature emanating from the firearm.

The muzzle brake cover can have concentric rings which can be equally spaced apart with a cut depth which does not penetrate the wall, such as concentric rings which can be formed 3.2 millimeters apart with a cut depth of 1.5 millimeters.

Though the cut depth here is depicted as being equal, the cut depth can vary between either consecutive or non-consecutive concentric rings.

The concentric rings can extend up to the entire length of the muzzle brake, such as concentric rings which cover from about 20 percent to about 80 percent from one end of the muzzle brake cover to the smooth portion.

The muzzle brake cover can have one or more concentric rings which can have a square cut.

The muzzle brake cover can have one or more concentric rings which can have a bevel, such as a bevel of about 30 degrees inclined towards the bore in line with the front end.

The muzzle brake cover can have a smooth portion which can provide a clearance between the slots on the muzzle brake and the smooth portion, such as a clearance from about 0.5 millimeters to about 3 millimeters.

Turning to the Figures, FIG. 1 depicts a side view of a muzzle brake cover according to one or more embodiments.

The muzzle brake cover 2 can include an extension 4 and a collar 26.

The extension 4 can form the body of the muzzle brake cover 2 and can include a front end 16. The extension can have an extension outer surface 5.

The collar 26 can have one or more tightening surfaces 28*a* and 28*c*.

Figure 2:
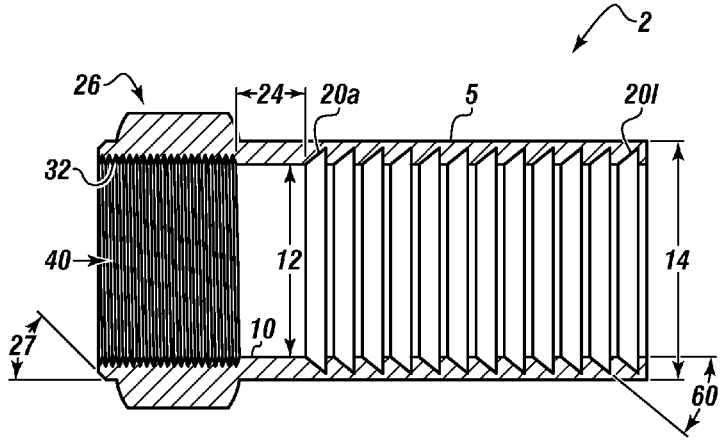
FIG. 2 depicts a cut-away side view of the muzzle brake cover according to one or more embodiments.

FIG. 2 depicts a cut-away side view of the muzzle brake cover according to one or more embodiments.

The muzzle brake cover 2 can include the cylindrical inner surface 10 with one or more concentric rings 20*a* and 20*l*.

The one or more concentric rings 20*a* and 201 can be spaced equidistantly or at varying intervals apart, when more than one is used, such as concentric rings at 3.2 millimeter intervals.

The concentric rings can include a ring bevel 60. The ring bevel 60 can be of any angle which helps break up the fireball of combustion gases that follow the departure of the projectile from the muzzle of the rifle.

The muzzle brake cover 2 can include a bore 40, which is designed to allow the projectile to pass through the muzzle brake cover 2 without damage.

The cylindrical inner surface 10 can also have a threaded portion 32, which can be used to connect the muzzle brake cover 2 with the muzzle brake.

Though the muzzle brake cover is depicted here with a threaded portion 32, the threaded portion can have one or more threads used as a connecting means. The connecting means can be of any type that can securely connect the muzzle brake cover to the muzzle brake, such a clamp, a hex head, or an external clamping mechanism for engaging the muzzle brake or the flash suppressor.

The cylindrical inner surface 10 can have an inner diameter 12. The inner diameter 12 can be less than the extension outer diameter 14 of the extension outer surface 5. The inner diameter 12 can be larger than the outer diameter of the muzzle brake.

The cylindrical inner surface 10 can also have a smooth portion 24, which can be positioned between the one or more concentric rings 20*a* and 201 and the threaded portion 32.

The muzzle brake cover 2 can have a collar 26. The collar 26 can include a collar bevel 27. The collar bevel 27 can have a slope from about 1 degree to about 179 degrees.

Figure 3:
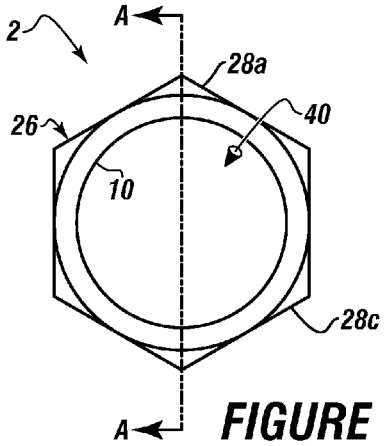
FIG. 3 depicts a rear view of the muzzle brake cover according to one or more embodiments.

FIG. 3 depicts a rear view of the muzzle brake cover according to one or more embodiments.

The muzzle brake cover 2 is shown with the collar 26 and with the one or more tightening surfaces 28*a* and 28*c*, such as tightening surfaces in a hex formation, which can assist the muzzle brake cover 2 in connecting with the muzzle brake.

The bore 40 can pass through the collar 26 of the muzzle brake cover 2, allowing the muzzle brake cover 2 to slide over the muzzle brake. The cylindrical inner surface 10 can connect with the muzzle brake.

Figure 4:
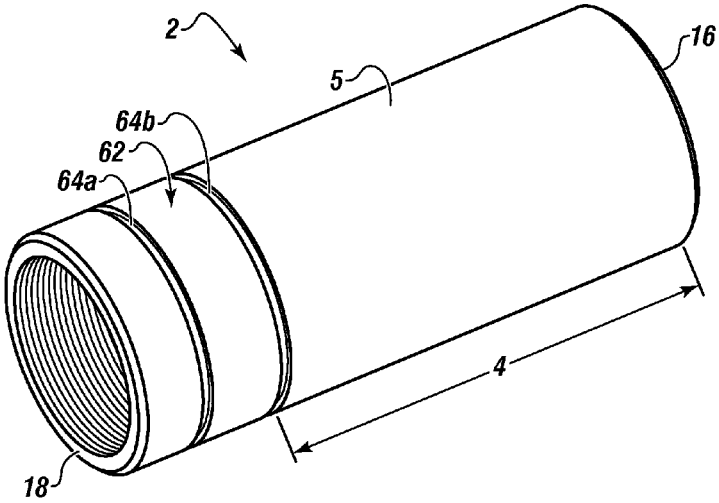
FIG. 4 depicts a side view of the muzzle brake cover with a smooth collar according to one or more embodiments.

FIG. 4 depicts a side view of the muzzle brake cover with a smooth collar according to one or more embodiments.

The muzzle brake cover 2 can include the extension 4 and a smooth collar 62.

The extension 4 can have an extension outer surface 5. The extension outer surface 5 can be of any texture, such as a brushed metal texture, and can be designed to meet the gripping needs of the user.

The smooth collar 62 can have one or more concentric grooves 64*a* and 64*b*. The concentric grooves 64*a* and 64*b* can be positioned to indicate the general position of internal components, such as one or more concentric grooves 64*a* and 64*b* positioned relative to the middle and end of the thread position.

The one or more concentric grooves 64*a* and 64*b* can be of various widths and depths, such as two concentric grooves with a width of 2 millimeters across.

The muzzle brake cover 2 can include a front end 16 and a back end 18.

Figure 5:
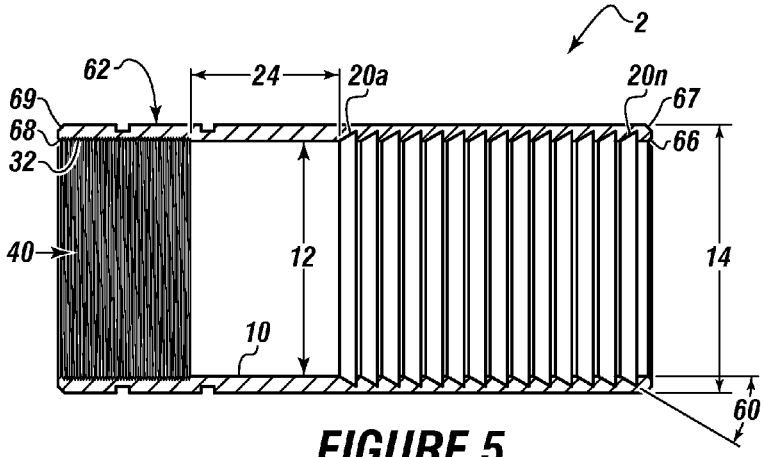
FIG. 5 depicts a cut-away side view of the muzzle brake cover with the smooth collar according to one or more embodiments.

FIG. 5 depicts a cut-away side view of the muzzle brake cover with the smooth collar according to one or more embodiments.

The muzzle brake cover 2 can include the cylindrical inner surface 10 with the one or more concentric rings 20*a* and 20*n*.

The one or more concentric rings 20*a* and 20*n* can be spaced equidistantly or at varying intervals apart, when more than one is used, such as concentric rings at 3.2 millimeter intervals. The one or more concentric rings can include the ring bevel 60.

The muzzle brake cover 2 can include the bore 40, which is designed to allow the projectile to pass through the muzzle brake cover 2 without direct contact with the muzzle brake cover 2.

The cylindrical inner surface 10 can also have the threaded portion 32, which can be used to connect the muzzle brake cover 2 with the muzzle brake.

Though the muzzle brake cover is depicted here with a threaded portion, the threaded portion can have one or more threads used as a connecting means. The connecting means can be of any type that can securely connect the muzzle brake cover to the muzzle brake, such a clamp, a hex head, or an external clamping mechanism for engaging the muzzle brake or the flash suppressor.

The cylindrical inner surface 10 can have an inner diameter 12. The inner diameter 12 can be less than the extension outer diameter 14 of the extension outer surface 5, shown in FIG. 4. The inner diameter 12 can be larger than the outer diameter of the muzzle brake.

The cylindrical inner surface 10 can also have the smooth portion 24, which can be positioned between the one or more concentric rings 20*a* and 20*n* and the threaded portion 32. The one or more concentric rings 20*a* and 20*n* can extend from the smooth portion 24 to the front end of the muzzle brake cover 2.

The muzzle brake cover 2 can have the smooth collar 62. The smooth collar 62 can include an inner surface which includes the threaded portion 32.

The front end can include a front inner bevel 66 and a front outer bevel 67. The front inner and outer bevels can have a slope from about 1 degree to about 179 degrees.

The back end can include a back inner bevel 68 and a back outer bevel 69. The back inner and outer bevels can have a slope from about 1 degree to about 179 degrees.

Figure 6:
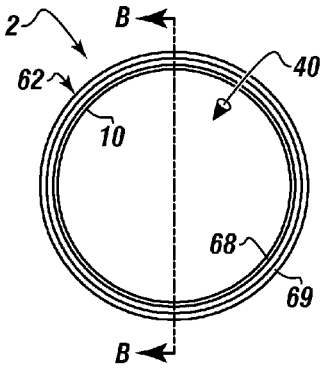
FIG. 6 depicts a rear view of the muzzle brake cover with a smooth collar according to one or more embodiments.

FIG. 6 depicts a rear view of the muzzle brake cover with a smooth collar according to one or more embodiments.

The muzzle brake cover 2 can have the smooth collar 62, which can provide the user with directionality for installation of the muzzle brake cover 2.

The bore 40 can pass through the smooth collar 62 of the muzzle brake cover 2, allowing the muzzle brake cover 2 to slide over the muzzle brake. The cylindrical inner surface 10 can connect with the muzzle brake.

The back inner bevel 68 and the back outer bevel 69 can allow for ease of installation of the muzzle brake cover 2 over the muzzle brake and for proper connection of the muzzle brake cover 2 with the muzzle brake and/or the barrel of the weapon.

While these embodiments have been described with emphasis on the embodiments, it should be understood that within the scope of the appended claims, the embodiments might be practiced other than as specifically described herein.

What is claimed is:

1. A muzzle brake cover providing blast diversion for firearms comprising:

an extension having a front end, a back end, and having a cylindrical inner surface with an inner diameter adapted to attach to and cover at least a portion of an outer cylindrical surface of a muzzle brake or flash suppressor of a firearm, wherein the inner diameter is larger than an outer diameter of the muzzle brake or flash suppressor;

b. one or more concentric grooves extending around the cylindrical inner surface of the extension to assist in flash suppression;

c. a threaded portion extending around the cylindrical inner surface of the extension for engaging the muzzle brake or flash suppressor;

d. a smooth inner surface portion disposed between the one or more concentric grooves and the threaded portion for fitting over portions of the muzzle brake or flash suppressor; and e. a collar on the outer surface of the extension to assist with tightening of the muzzle brake cover over the muzzle brake or the flash suppressor of the firearm.

2. The muzzle brake cover of claim 1, wherein the threaded portion has one or more threads.

3. The muzzle brake cover of claim 1, wherein the one or more concentric grooves are formed equidistantly apart with a cut depth that does not penetrate the wall of the muzzle brake cover.

4. The muzzle brake cover of claim 1, wherein the one or more concentric grooves are formed 3.2 millimeters apart with a cut depth of 1.5 millimeters and extending from 20 percent to 80 percent from one end of the muzzle brake cover to the smooth portion.

5. The muzzle brake cover of claim 1, wherein the one or more concentric grooves have a square cut.

6. The muzzle brake cover of claim 1, wherein one or more concentric grooves have a ring bevel of 30 degrees inclined towards a bore in line with the front end.

7. The muzzle brake cover of claim 1, wherein the smooth portion provides a clearance between the inner surface and the muzzle brake or flash suppressor outer surface of 0.5 millimeters to 3 millimeters.

8. The muzzle brake cover of claim 1, further comprising one or more tightening surfaces on the collar.

* * * * *